US010172384B2

(12) United States Patent
Le Roux et al.

(10) Patent No.: US 10,172,384 B2
(45) Date of Patent: Jan. 8, 2019

(54) SMOKING ARTICLE ASSEMBLY MACHINE FOR ASSEMBLING SMOKING ARTICLES HAVING SEGMENTED FILTERS

(71) Applicant: Tobacco Research and Development Institute (Proprietary) Limited, Stellenbosch (ZA)

(72) Inventors: Gerhard Le Roux, Paarl (ZA); Arnold Leslie Herholdt, Brackenfell (ZA)

(73) Assignee: TOBACCO RESEARCH AND DEVELOPMENT INSTITUTE (PROPRIETARY) LIMITED, Stellenbosch (ZA)

( * ) Notice: Subject to any disclaimer, the term of this patent is extended or adjusted under 35 U.S.C. 154(b) by 96 days.

(21) Appl. No.: 15/305,536

(22) PCT Filed: Mar. 31, 2015

(86) PCT No.: PCT/EP2015/057127
§ 371 (c)(1),
(2) Date: Oct. 20, 2016

(87) PCT Pub. No.: WO2015/165683
PCT Pub. Date: Nov. 5, 2015

(65) Prior Publication Data

US 2017/0035100 A1 Feb. 9, 2017

(30) Foreign Application Priority Data

Apr. 29, 2014 (GB) ..... 1407513.9

(51) Int. Cl.
*A24C 5/47* (2006.01)
*A24C 5/10* (2006.01)
(Continued)

(52) U.S. Cl.
CPC ..... *A24C 5/471* (2013.01); *A24C 5/10* (2013.01); *A24C 5/28* (2013.01); *A24C 5/473* (2013.01);
(Continued)

(58) Field of Classification Search
CPC .. A24C 5/185; A24C 5/12; A24C 5/28; A24C 5/47; A24C 5/471; A24C 5/473;
(Continued)

(56) References Cited

U.S. PATENT DOCUMENTS 2,740,409 A * 4/1956 Korber ..... A24C 5/471 131/361
3,306,306 A * 2/1967 Rudszinat ..... A24C 5/475 131/94
(Continued)

FOREIGN PATENT DOCUMENTS

CN 1081340 A 2/1994
CN 1874695 A 12/2006
(Continued)

OTHER PUBLICATIONS

Chinese Office Action for corresponding application 201580023368.2 filed Mar. 31, 2015; Report dated Sep. 4, 2017.
(Continued)

*Primary Examiner* — Alex B Efta
(74) *Attorney, Agent, or Firm* — Cantor Colburn LLP

(57) ABSTRACT

A smoking article assembly apparatus is disclosed. It comprises a first cutting station configured to cut a filter rod into filter segments, a tipping station configured to join the filter segments to tobacco rods so as to form a smoking article assembly, and a second cutting station configured to cut the smoking article assembly in the region of the filter segments so as to form two smoking articles.

12 Claims, 3 Drawing Sheets

(51) Int. Cl.

| | |
|---|---|
| ***A24C 5/58*** | (2006.01) |
| ***A24C 5/28*** | (2006.01) |
| ***A24D 3/02*** | (2006.01) |
| ***B26D 1/22*** | (2006.01) |
| ***B26D 1/09*** | (2006.01) |

(52) U.S. Cl.
CPC ..... *A24C 5/475* (2013.01); *A24C 5/478* (2013.01); *A24C 5/586* (2013.01); *A24D 3/0254* (2013.01); *B26D 1/22* (2013.01); *A24D 3/0287* (2013.01); *A24D 3/0291* (2013.01); *B26D 1/09* (2013.01)

(58) Field of Classification Search
CPC ..... A24C 5/475; A24C 5/478; A24C 5/586; A24C 5/10; A24D 3/0208; A24D 3/0291; A24D 3/0287; B26D 1/09
See application file for complete search history.

(56) References Cited

U.S. PATENT DOCUMENTS

| | | | | |
|---|---|---|---|---|
| 3,308,832 | A * | 3/1967 | Stelzer | A24C 5/475 131/94 |
| 3,368,460 | A * | 2/1968 | Schubert | A24D 3/0287 198/418.2 |
| 3,382,874 | A * | 5/1968 | Pinkham | A24C 5/36 131/280 |
| 3,384,094 | A | 5/1968 | Molins | |
| 5,349,968 | A | 9/1994 | Rizzoli | |
| 8,360,947 | B2 * | 1/2013 | Eusepi | A24D 3/0287 131/88 |
| 2005/0199251 | A1 | 9/2005 | Wonowidjojo | |
| 2006/0025292 | A1 | 2/2006 | Hicks | |
| 2006/0065278 | A1 | 3/2006 | Jahnke | |
| 2006/0144409 | A1 | 7/2006 | Dombek | |
| 2007/0028933 | A1 | 2/2007 | Rizzoli | |
| 2013/0118510 | A1 | 5/2013 | Kaljura | |

FOREIGN PATENT DOCUMENTS

| | | | |
|---|---|---|---|
| EP | 0576006 | A2 | 12/1993 |
| EP | 0580150 | A1 | 1/1994 |
| EP | 0679343 | A2 | 11/1995 |
| GB | 818440 | A | 7/1957 |
| GB | 832462 | | 7/1958 |
| GB | 915203 | | 2/1959 |
| GB | 922230 | | 10/1959 |
| GB | 971491 | | 11/1960 |
| GB | 2241866 | A | 9/1991 |
| WO | 2011131465 | A1 | 12/2011 |
| WO | 2012126588 | A1 | 9/2012 |
| WO | 2012164067 | A2 | 12/2012 |

OTHER PUBLICATIONS

International Preliminary Report on Patentability for corresponding application PCT/EP2015/057127 filed Mar. 31, 2015; dated May 2, 2016.
International Search Report of the International Searching Authority for corresponding application PCT/EP2015/057127 filed Mar. 31, 2015; dated Jul. 10, 2015.
Response to the Written Opinion of the International Searching Authority dated Jul. 10, 2015 for International (PCT) Patent Application No. PCT/EP2015/057127; dated Nov. 17, 2015.
Written Opinion of the International Searching Authority for corresponding application PCT/EP2015/057127 filed Mar. 31, 2015; dated Jul. 10, 2015.
Russian Office Action for corresponding application 2016142310; Report dated Nov. 30, 2017.
Korean Office Action for corresponding Application No. 10-2016-7029852; Report dated Jan. 31, 2018.

* cited by examiner

SMOKING ARTICLE ASSEMBLY MACHINE FOR ASSEMBLING SMOKING ARTICLES HAVING SEGMENTED FILTERS

FIELD OF THE INVENTION

This invention relates to a smoking article assembly machine for assembling smoking articles having segmented filters. The invention also relates to a method for assembling smoking articles having segmented filters.

BACKGROUND

It is known to provide machines for assembling smoking articles such as cigarettes. These machines typically comprise a series of drums configured to transfer and/or assemble a filter rod with a tobacco rod so as to form a smoking article. Certain drums are configured so that particular operations are carried out as the rod articles are conveyed by the drum. Once the smoking articles have been assembled, they are transferred to a packaging stage where they are grouped together and enclosed in a packet.

SUMMARY

According to the present invention there is provided a smoking article assembly apparatus comprising a first cutting station configured to cut a filter rod into filter segments, a tipping station configured to join the filter segments to tobacco rods so as to form a smoking article assembly, and a second cutting station configured to cut the smoking article assembly in the region of the filter segments so as to form two smoking articles The term "smoking article" is to be understood as smokeable products such as cigarettes, cigars and cigarillos whether based on tobacco, tobacco derivatives, expanded tobacco, reconstituted tobacco or tobacco substitutes and also heat-not-burn products.

The tipping station may be configured to apply a tipping patch to the filter segments and the tobacco rods simultaneously such that the filter segments are enclosed and joined to the tobacco rods.

The first cutting station may be configured to receive two tobacco rods and a filter rod located between the two tobacco rods.

The first cutting station may comprise a rotatable first drum and a first cutting device, and the cutting device may comprise at least two knives.

The at least two knives may be configured to cut the filter rod into segments during a single rotation of the first drum.

The position of the knives may be adjustable to alter the length of the filter segments.

The first cutting station may be upstream relative to the second cutting station.

In various embodiments, the first cutting station, the tipping station and the second cutting station form part of a continuous path for tobacco industry rod articles The term "tobacco industry rod article" used herein includes a rod such as tobacco rod, filter rod, other rod-like articles suitable for inclusion in a smoking article, and a smoking article itself, unless otherwise specified.

The present invention also provides a method of making smoking articles comprising locating a filter rod between tobacco rods, cutting the filter rod into filter segments, applying a tipping patch so to join the filter segments to adjacent tobacco rods so as to form a smoking article assembly, and cutting the smoking article assembly in the region of the filter segments so as to form two smoking articles, each having two or more filter components.

The filter rod may be cut into at least three segments before a tipping patch is applied. The filter rod may be cut into at least three segments simultaneously.

Locating a filter rod between tobacco rods may comprise locating a single filter rod between tobacco rods.

BRIEF DESCRIPTION OF THE DRAWINGS

Embodiments of the invention will now be described, by way of example only, with reference to the accompanying drawings in which.

DETAILED DESCRIPTION

Figure 1:
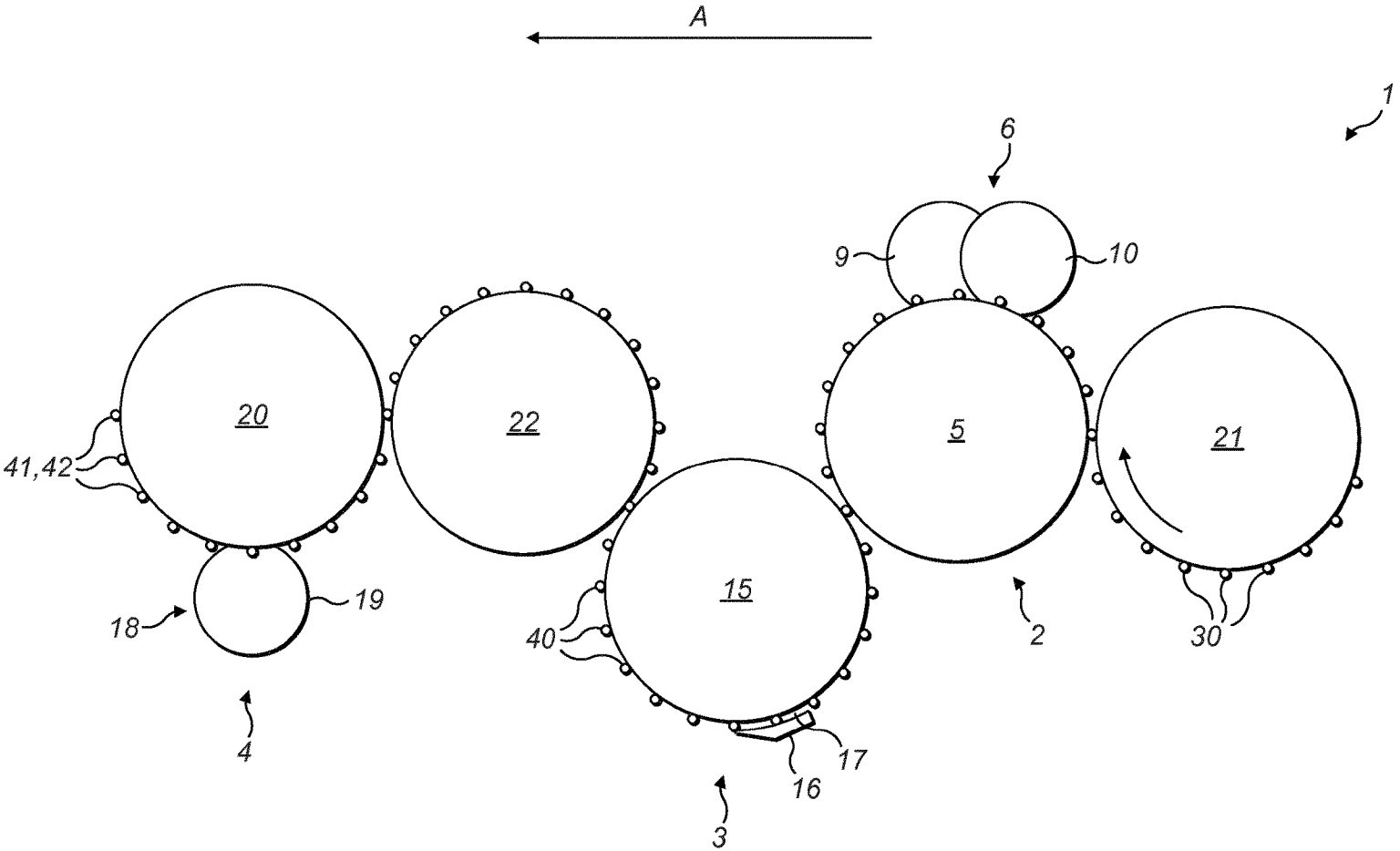
FIG. 1 shows a schematic illustration of a part of a smoking article assembly apparatus according to the present invention.

Referring now to the drawings, FIG. 1 shows a schematic illustration of a part 1 of a smoking article assembly apparatus which prepares segmented filters and assembles smoking articles comprising said segmented filters.

The term "segmented filtered smoking article" as used herein is to be understood as a smoking article having a plurality of filter components.

The part 1 illustrated in FIG. 1 forms part of a series of drums forming a production line for preparing smoking articles. However, for the sake of clarity, upstream and downstream drums relative to the part 1 of the smoking article assembly apparatus according to the present invention have been omitted from the drawings.

The part 1 of the smoking article assembly apparatus according to the present invention comprises a first cutting station 2, a tipping station 3 followed by a second cutting station 4. In use, products produced by the part 1 of a smoking article assembly apparatus, and components for forming such products, are conveyed from left to right in FIG. 1, in the direction shown by arrow A. Each station will now be described in more detail.

Figure 2:
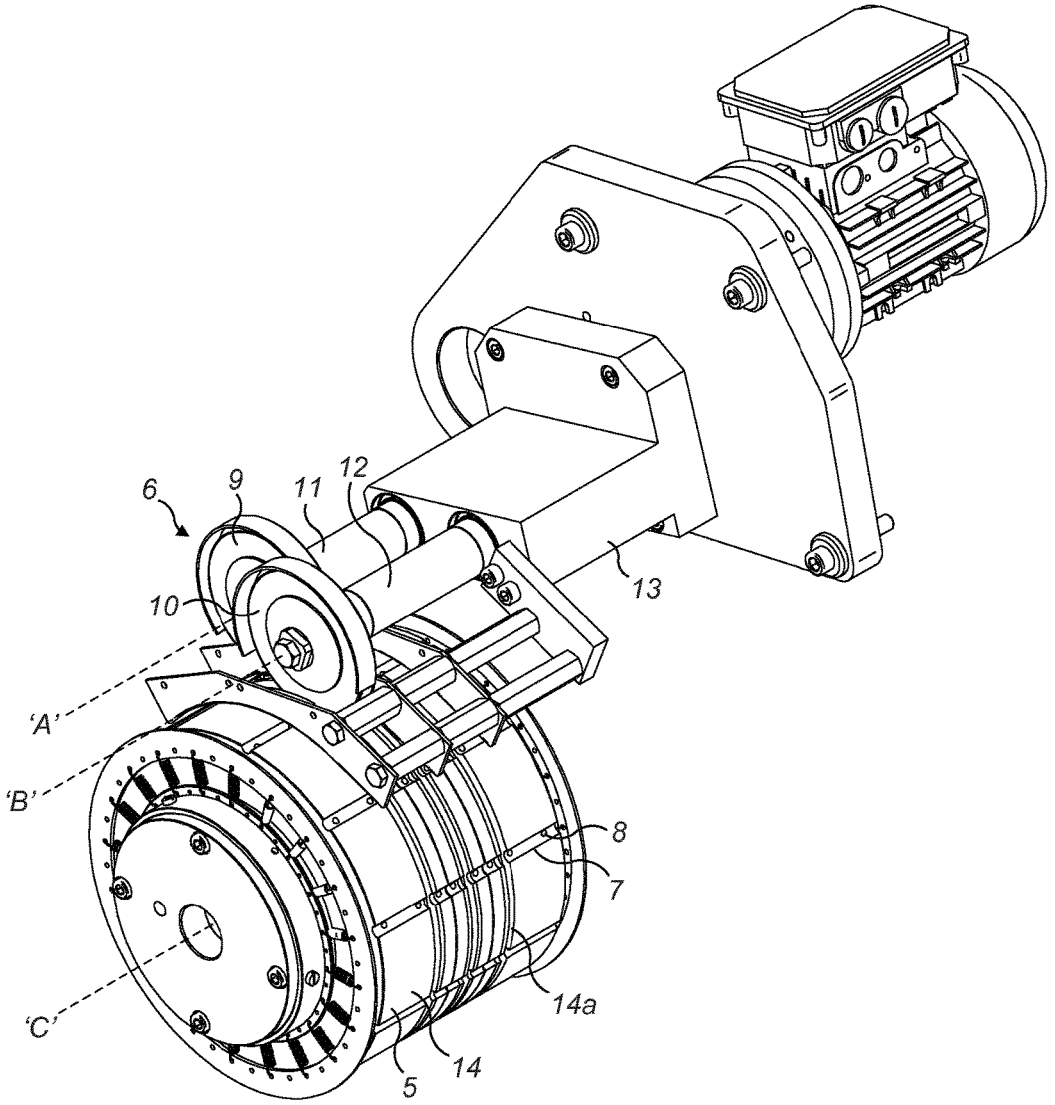
FIG. 2 shows a perspective view of a first cutting station forming part of the present invention.

The first cutting station 2 comprises a first cutting device 6 and a first drum 5 as illustrated in FIG. 1. The first cutting device 6 comprises two knives 9, 10 each rotatable about their central axis 'A' and 'B' as is best seen in FIG. 2. The knives 9, 10 are configured to cut a filter rod into three segments so as to form segments. Each knife 9, 10 is supported by an arm 11, 12 connected to a base 13. The arms 11, 12 are adjustable along their axis, 'A' and 'B', relative to the base 13 such that the position of the knives 9, 10 can be changed. By adjusting the position of the knives 9, 10 the length of the segments can be altered.

The first drum 5 of the first cutting device 6 is rotatable about its central axis 'C' which is parallel to the central axes 'A' and 'B' of the knives 9, 10. The first drum 5 is formed with grooves 7 for receiving tobacco industry rod articles as is best seen in FIG. 2. Each groove 7 has valve-operated holes 8 through which suction can be applied to tobacco industry rod articles received in the grooves such that the tobacco industry rod articles can be retained in its groove 7 as the first drum 5 rotates. A circumferential surface 14 of the first drum 5 is formed with tracks or channels 14*a*. These channels 14*a* are configured to receive the knives 9, 10 such that they cut through the whole cross-section of a filter rod as described below. As can be appreciated from FIG. 2, the circumferential surface 14 comprises a plurality of tracks 14*a* next to one another. This is to accommodate for the knives 9, 10 being adjustable along their axes 'A' and 'B'.

The tipping station 3 as illustrated in FIG. 1 comprises a rolling drum 15 and a rolling hand 16 which together define a space or a channel 17 through which tobacco industry rod articles pass such that they are enclosed in a tipping paper (not shown). Those skilled in the art will be aware of various tipping stations and associated machinery and so it will not be described in detail here. However, it should be understood that the rolling drum 15 rotates about an axis and is formed with grooves similar to the first drum 5 of the first cutting station 2, and that the rolling hand 16 is stationary.

The second cutting station 4 comprises a second drum 20 and a second cutting device 18. The second cutting device 18 comprises a knife 19 rotatable about its own central axis. The knife 19 is configured to cut the wrapped segmented filter prepared at the first cutting station 2 into half. Similar to the first drum 5, the second drum 20 is formed with grooves having valve-operated holes for applying suction to tobacco industry rod articles.

Figure 3A:
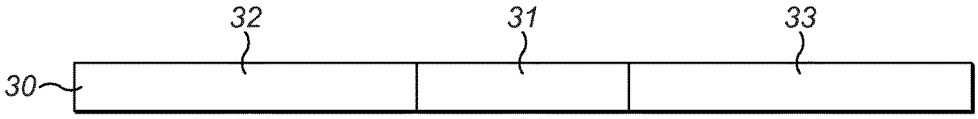
FIG. 3*a*-3*e* shows a schematic illustration of assembly stages of a segmented filtered smoking article according to the present invention.
Figure 3B:
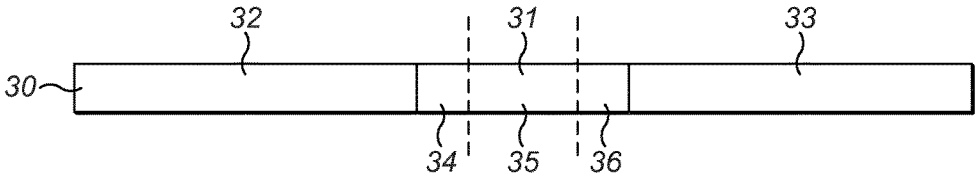
Figure 3C:
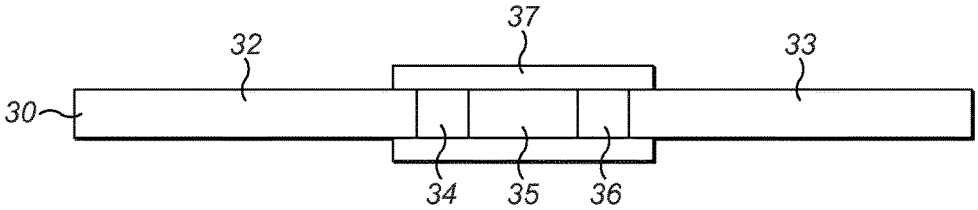
Figure 3D:
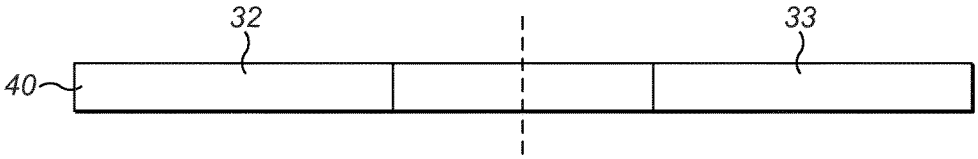

Operation of the smoking article assembly machine will now be described with reference to FIGS. 1 and 2, and reference will be made to the assembly stages of the smoking articles as illustrated in FIGS. 3*a* to 3*e*. The first drum 5 of the first cutting station 2 receives a double-length filter rod 31 (known as a "2-up" filter rod) located between two tobacco rods 32, 33 (see FIG. 3*a*) and for ease of reference, this arrangement is referred to as a pre-smoking article assembly 30. Each groove 7 of the first drum 5 receives such a pre-smoking article assembly 30 from an initial transfer drum 21 or a similar drum forming part of the online production. As the first drum 5 rotates about its axis 'C', the pre-smoking article assemblies 30 are transferred past the two knives 9, 10 such that the knives 9, 10 cut the filter rod 31 of the pre-smoking article assembly 30 into three segments 34, 35, 36 (see FIG. 3*b*). The dashed lines in FIG. 3*b* represent the cutting points of the filter rod 31.

The cut pre-smoking article assemblies 30 are then transferred from the first drum 5 to the rolling drum 15 of the tipping station 3. A cut pre-smoking article assembly 30 locates in each groove of the rolling drum 15 and as they pass the rolling hand 16 it is wrapped in a tipping paper 37 such that the cut or segmented filter 31 is joined to the two adjacent tobacco rods 32, 33 so as to form a smoking article assembly 40 (see FIG. 3*c*). Each wrapped smoking article assembly 40 is then passed to a groove of the second drum 20 of the second cutting station 4 via an intermediate drum 22. As each wrapped smoking article assembly 40 passes the associated knife 19 of the second cutting device 18, the knife 19 cuts the wrapped smoking article assembly 40 in the region of the filter rod 31 such that the filter rod is cut in half. The cut is illustrated by the dashed line in FIG. 3*d*.

Figure 3E:
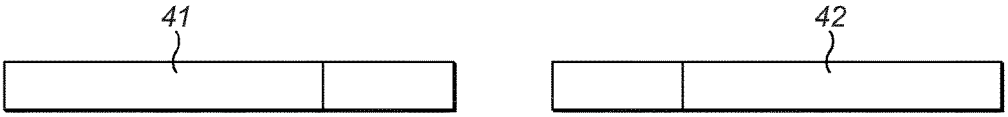

As the filter rod 31 is cut in half, two segmented filtered smoking articles 41, 42 are formed as is illustrated in FIG. 3*e*, wherein each smoking article comprises a tobacco rod and a segmented single length ("1-up") filter rod.

Thereafter the smoking articles 41, 42 may be separated using known techniques and then transferred to a packaging station (not shown).

It should be understood that the first drum 5, rolling drum 15, intermediate transfer drum 22 and the second drum 20 are operated such that vacuum is applied at the correct rotational position so as to allow for the pre-smoking article assemblies 30 and the smoking article assemblies 40 to be picked up, transferred and released as described above. Also, in an alternative embodiment of the invention, the intermediate transfer drum 22 may be omitted and the wrapped smoking article assemblies 40 may be transferred directly from the rolling drum 15 to the second drum 20.

It should also be understood that the present invention is not limited to 2-up filter rods as any suitable filter length may be located between the two tobacco rods. Furthermore, the present invention is not limited to two knives in the first cutting station 2. It should be understood that the first cutting station 2 may comprise at least two knives, for example, it may comprise three or four knives such that the filter rod 31 is cut into four or five segments respectively.

As mentioned above, the first cutting station 2, the tipping station 3 and the second cutting station 4 are parts of a series of drums configured to transfer and/or assemble a segmented filtered smoking article. Advantageously, the filter rod 31 is cut into segments in an online process (i.e. on the production line of the smoking article assembly apparatus) which minimises production steps and increases the production speed. Additionally, this online process of filter rod cutting advantageously reduces the time and cost for change of filter segment length if production of different filter rod lengths is required. Yet further, this process also can eliminate the need for additional plug wrap to be used for combined filters as a single tipping paper 37 is used to wrap around all filter segments 34, 35, 36 following cutting.

Furthermore, as the filter rod 31 is cut into segments when located between the tobacco rods, the tipping paper encloses bare filter segments simultaneously as it joins them to the tobacco rods, thus only two cutting stations are required in order to form two segmented filtered smoking articles.

Although the invention is described as a permanent part of smoking article assembly apparatus, in an alternative example, the part 1 is a module of a modular smoking article assembly apparatus. Modular smoking article assembly apparatus is described in International Patent Application Publication Number WO 2012/164067.

In order to address various issues and advance the art, the entirety of this disclosure shows by way of illustration various embodiments in which the claimed invention(s) may be practiced and provide for a superior tobacco industry rod assembly apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article assembly apparatus comprising a first cutting station configured to cut a filter rod into at least three filter segments, a tipping station configured to join the filter segments to tobacco rods so as to form a smoking article assembly, and a second cutting station configured to cut the smoking article assembly in a region of the filter segments so as to form two smoking articles, wherein the first cutting station is configured to receive two tobacco rods and a filter rod located between the two tobacco rods.

2. A smoking article assembly apparatus according to claim 1, wherein the tipping station is configured to apply a tipping patch to the filter segments and the tobacco rods simultaneously such that the filter segments are enclosed and joined to the tobacco rods.

3. A smoking article assembly apparatus according to claim 1, wherein the first cutting station comprises a rotatable first drum and a first cutting device, and the cutting device comprises at least two knives.

4. A smoking article assembly apparatus according to claim 3, wherein the at least two knives are configured to cut the filter rod into segments during a single rotation of the first drum.

5. A smoking article assembly apparatus according to claim 3, wherein the position of the knives is adjustable to alter the length of the filter segments.

6. A smoking article according to claim 1, where in the first cutting station is upstream relative to the second cutting station.

7. A smoking article assembly apparatus according to claim 1, wherein the first cutting station, the tipping station and the second cutting station form part of a continuous path for tobacco industry rod articles.

8. A method of making smoking articles comprising locating a filter rod between tobacco rods, cutting the filter rod into at least three filter segments, applying a tipping patch to join the filter segments to tobacco rods so as to form a smoking article assembly, and cutting the smoking article assembly in a region of the filter segments so as to form two smoking articles, each having two or more filter components.

9. A method according to claim 8, wherein the tipping patch is applied to the filter segments and tobacco rods simultaneously so as to form the smoking article assembly.

10. A method according to claim 8, wherein the filter rod is cut into at least three segments before a tipping patch is applied.

11. A method according to claim 10, wherein the filter rod is cut into at least three segments simultaneously.

12. A method according to claim 8, wherein the filter rod located between the tobacco rods is a single filter rod.

* * * * *